US007657959B2

(12) United States Patent
Smith et al.

(10) Patent No.: US 7,657,959 B2
(45) Date of Patent: Feb. 9, 2010

(54) RELEASABLE PAINT ROLLER COVER RETAINER

(75) Inventors: Robin E. Smith, Stanley, NC (US); Natalia Johnson, Statesville, NC (US); Christopher John Parke, Cornelius, NC (US); Brandon Seth Cross, Huntersville, NC (US); George Andrew Hartel, Huntersville, NC (US); Kimberly Clendenen Franklin, Statesville, NC (US)

(73) Assignee: Newell Operating Company, Freeport, IL (US)

( * ) Notice: Subject to any disclaimer, the term of this patent is extended or adjusted under 35 U.S.C. 154(b) by 328 days.

(21) Appl. No.: 11/901,413

(22) Filed: Sep. 17, 2007

(65) Prior Publication Data

US 2009/0070943 A1 Mar. 19, 2009

(51) Int. Cl.
*B05C 17/02* (2006.01)

(52) U.S. Cl. ..... 15/230.11; 492/13; 492/19

(58) Field of Classification Search ..... 15/230.11; 492/13, 19

See application file for complete search history.

(56) References Cited

U.S. PATENT DOCUMENTS

| | | | |
|---|---|---|---|
| 1,728,417 | A | 9/1929 | Lewis |
| 1,887,790 | A | 11/1932 | Stogner |
| 2,113,141 | A | 4/1938 | Huenlich et al. |
| 2,197,883 | A | 4/1940 | Sinclair |
| 2,263,439 | A | 11/1941 | Hansen |
| 2,520,863 | A | 8/1950 | Thomas et al. |
| 2,647,276 | A | 8/1953 | Thomas et al. |
| 2,669,743 | A | 2/1954 | Coughlin |
| 2,675,605 | A | 4/1954 | Thomas |
| 2,678,473 | A | 5/1954 | Butler |
| 2,684,497 | A | 7/1954 | Graham |
| 2,891,301 | A | 6/1959 | Conklin |
| 2,935,757 | A | 5/1960 | Phillips |
| 2,970,366 | A | 2/1961 | Gill |
| 2,977,671 | A | 4/1961 | Wiegand |
| 2,982,010 | A | 5/1961 | Johns |
| 2,987,746 | A | 6/1961 | Davis et al. |
| 3,060,555 | A | 10/1962 | Kirshenbaum et al. |
| 3,335,446 | A | 8/1967 | McGinley |
| 3,447,184 | A | 6/1969 | McGinley |
| 3,638,271 | A | 2/1972 | Pharris et al. |
| 3,711,887 | A | 1/1973 | Chapman |
| 3,745,624 | A | 7/1973 | Newman |
| 3,751,748 | A | 8/1973 | Roe et al. |

(Continued)

FOREIGN PATENT DOCUMENTS

| | | | |
|---|---|---|---|
| EP | 1 604 745 | A | 12/2005 |

(Continued)

*Primary Examiner*—Mark Spisich
(74) *Attorney, Agent, or Firm*—Taft Stettinius & Hollister LLP

(57) ABSTRACT

A paint roller including a roller cover retainer that is releasable to permit a roller cover to be easily removed. The device includes a locking lever pivotable relative to the frame which actuates retainers located within the roller assembly. The locking lever also exerts an axial force adapted to disengage the roller cover from the roller assembly when the retainer is disengaged. A used roller cover can be removed without the need to grasp the used roller cover. Installation of a roller cover onto the roller assembly automatically engages the retainers and shifts the locking lever into the locked position.

20 Claims, 10 Drawing Sheets

U.S. PATENT DOCUMENTS

| | | | |
|---|---|---|---|
| 3,774,278 | A | 11/1973 | Ashton |
| 3,832,749 | A | 9/1974 | Hawk |
| 3,877,123 | A | 4/1975 | Pharris |
| 3,986,226 | A | 10/1976 | Roe et al. |
| 4,209,883 | A | 7/1980 | Hawk |
| 4,316,301 | A | 2/1982 | Smith et al. |
| 4,361,923 | A | 12/1982 | McKay |
| 4,402,102 | A | 9/1983 | Al-samman |
| 4,615,634 | A | 10/1986 | Matsuda |
| 4,717,276 | A | 1/1988 | O'Brien et al. |
| 4,897,893 | A | 2/1990 | Barker |
| 4,937,909 | A | 7/1990 | Georgiou |
| 4,985,959 | A | 1/1991 | Lieberman et al. |
| 5,210,899 | A | 5/1993 | Goldstein et al. |
| 5,345,648 | A | 9/1994 | Graves |
| 5,490,303 | A | 2/1996 | Graves |
| 5,619,769 | A | 4/1997 | Hutt |
| 5,806,131 | A | 9/1998 | Tennant |
| 5,870,795 | A | 2/1999 | Sizemore |
| 5,903,952 | A | 5/1999 | Camp, Jr. et al. |
| 5,979,009 | A | 11/1999 | Polzin et al. |
| 5,987,692 | A | 11/1999 | Sizemore |
| 6,012,473 | A | 1/2000 | Koyama |
| 6,066,053 | A | 5/2000 | Sehemberger |
| 6,101,662 | A | 8/2000 | Polzin et al. |
| 6,102,382 | A | 8/2000 | Labesky |
| 6,182,322 | B1 | 2/2001 | Tubman |
| 6,367,114 | B1 | 4/2002 | Babkowski |
| 6,378,158 | B1 | 4/2002 | Bukovitz |
| 6,405,404 | B2 | 6/2002 | Babkowski |
| 6,438,788 | B1 | 8/2002 | Gartner |
| 6,473,931 | B2 | 11/2002 | Chang |
| 6,510,579 | B1 | 1/2003 | Gartner |
| 6,729,038 | B2 | 5/2004 | Lonier |
| 6,851,155 | B2 | 2/2005 | Dove |
| 6,928,689 | B2 | 8/2005 | Dove |
| 7,028,365 | B2 | 4/2006 | Martin et al. |
| 7,120,963 | B2 | 10/2006 | Kim |
| 2004/0205921 | A1 | 10/2004 | Woodruff et al. |
| 2006/0130261 | A1 | 6/2006 | Futo et al. |
| 2007/0256268 | A1 | 11/2007 | Mertins, Jr. |

FOREIGN PATENT DOCUMENTS

| | | | |
|---|---|---|---|
| GB | 2 399 522 | A | 9/2004 |
| GB | 2 443 919 | A | 5/2008 |
| WO | WO 00/37184 | | 6/2000 |
| WO | WO 2008-053195 | | 5/2008 |

RELEASABLE PAINT ROLLER COVER RETAINER

BACKGROUND OF THE INVENTION

The present invention relates to a roller assembly for use in applying a coating to a surface, and, more particularly, to a paint roller frame and roller support assembly that allows easy installation of a roller cover onto the roller support, securely retains the roller cover on the roller support during painting, and permits convenient and minimally messy removal of the roller cover from the roller support following use.

Paint rollers with removable covers are well known. Normally a roller cover is installed on a roller support such that the roller cover can be removed from the roller support and cleaned or discarded after use. Paint rollers with mechanisms designed to releasably retain a roller cover on the roller support are known. See, for example, U.S. Pat. Nos. 5,345,648 and 5,490,303 to Graves. Roller frames and support assemblies of this type utilize a plurality of small, flexible metal fingers that are deflected radially inward as a roller cover is installed. The metal fingers press outward against the inner surface of the roller cover, thus holding the cover in place during use. The roller cover is removed from the support assembly by grasping it and pulling it axially off of the support assembly. Alternatively, the roller cover may be removed from the support assembly by striking roller frame on a solid object, causing the roller cover to slide off of the support assembly. Both of these methods for removing the roller cover are undesirable because they are potentially messy for the user. U.S. Pat. No. 7,028,365 discloses a similar paint roller which utilizes the same undesirable methods for removing the roller cover.

Other known roller cover retention devices include spring-biased tabs that are manually retracted by depressing a button on the roller handle. These designs are significantly disadvantageous because the tabs must be retracted prior to installing a roller cover. Some consumers find this counterintuitive and their attempts to install a roller cover without properly retracting the tabs may result in dissatisfaction with or damage to the device. Additionally, the button mechanism may require the user to apply a substantial amount of force to overcome the biasing force of the springs which extend the tabs. This makes the device less consumer-friendly, particularly for those with smaller hands or limited grip strength.

All of the previously described paint rollers are designed to accommodate standard paint roller covers, meaning that many manufacturers produce roller frames and roller covers to the same general specifications such that the frames and covers are generally interchangeable among manufacturers. Other devices utilize non-standard paint roller covers. See, e.g., U.S. Patent Application Publication No. 2006/0130261. These devices are inherently disadvantageous because they do not permit the use of widely-available and inexpensive standard roller covers.

Based on the foregoing, it would be desirable to provide a paint roller assembly using standard roller covers that allows easy installation of the roller cover, securely retains the roller cover during painting, and permits convenient and minimally messy removal of the roller cover following use.

BRIEF SUMMARY OF THE INVENTION

According to the present invention, a paint roller having improved features is provided.

In a first aspect, the present invention paint roller may include a frame having an elongated portion with a terminal end and a contiguous end; a roller assembly rotatably coupled to the elongated portion of the frame and adapted to receive a removable paint roller cover, the roller assembly including an axially movable portion and retainers; and a locking lever pivotably coupled to the frame and adapted to cause axial movement of the axially movable portion of the roller assembly when the locking lever is pivoted relative to the frame. The retainers may slidingly engage the axially movable portion such that axial motion of the axially movable portion causes the retainers move radially relative to the elongated portion of the frame. Pivoting the locking lever to the locked position may cause the retainers to move radially away from the elongated portion of the frame and pivoting the locking lever to the released position may cause the retainers to move radially towards the elongated portion of the frame. Moving the locking lever from the locked position to the released position may cause the axially movable portion to move toward the terminal end and moving the locking lever from the released position to the locked position may cause the axially movable portion to move toward the contiguous end.

An embodiment of the first aspect may include a flange on the axially movable portion that at least partially disengages the roller cover from the roller assembly when the locking lever is moved from the locked position to the released position. During installation of the roller cover, the roller cover may exert a force on the flange generally parallel to the elongated portion of the frame and generally in the direction of the contiguous end, thus causing the locking lever to pivot from the released position to the locked position.

In another embodiment of the first aspect, the retainers may each have a first end pivotably captured by a portion of the roller assembly and a second end including a contact surface that slidably contacts the axially movable portion. Further, the radius of the contact portion of the axially movable portion may vary along its axial length such that the second ends of the retainers are moved radially away from the elongated roller portion of the frame as the axially movable portion is moved axially toward the contiguous end. The retainers may be composed of metal and may each include a tab adapted to mechanically engage the roller cover when the locking lever is in the locked position. In an embodiment, the paint roller may include four retainers. The retainers may also be composed of other materials such as, but not limited to, plastic.

In a second aspect, the present invention paint roller may include a frame having an elongated portion with a terminal end and a contiguous end; a roller assembly rotatably coupled to the elongated portion of the frame that is adapted to receive a removable paint roller cover and including an axially movable portion and metal retainers; a locking lever pivotably coupled to the frame and adapted to cause axial movement of the movable portion of the roller assembly when the locking lever is pivoted relative to the frame. The retainers may slidingly engage the axially movable portion such that axial motion of the axially movable portion causes the retainers move radially relative to the elongated portion of the frame and the retainers may each have a first end pivotably captured by a portion of the roller assembly and a second end including a contact surface that slidably contacts the axially movable portion. Pivoting the locking lever to the locked position may cause the retainers to move radially away from the elongated portion of the frame and pivoting the locking lever to a released position may cause the retainers to move radially towards the elongated portion of the frame. Motion of the locking lever from the locked position to the released position may cause the axially movable portion to move toward the terminal end and motion of the locking lever from the released position to the locked position may cause the axially movable portion to move toward the contiguous end. The contact portion of the axially movable portion may have a radius that varies along its axial length such that the second ends of the retainers are moved radially away from the elongated roller portion of the frame as the axially movable portion is moved axially toward the contiguous end. Each retainer may include a tab adapted to mechanically engage the roller cover when the locking lever is in the locked position.

In an embodiment of the second aspect, the paint roller may include a flange on the axially movable portion that at least partially disengages the roller cover from the roller assembly when the locking lever is moved from the locked position to the released position. During installation, the roller cover may push axially on the flange, causing the locking lever to pivot from the released position to the locked position. An embodiment of the paint roller may include four retainers.

In a third aspect, the present invention paint roller may include a frame having an elongated portion with a terminal end and a contiguous end; a roller assembly rotatably coupled to the elongated portion of the frame that is adapted to receive a removable paint roller cover and includes an axially movable portion having a flange; and retainers. The retainers may slidingly engage the axially movable portion such that axial motion of the axially movable portion causes the retainers move radially relative to the elongated portion of the frame and each retainer may have a first end pivotably captured by a portion of the roller assembly and a second end including a contact surface that slidably contacts the axially movable portion. A locking lever pivotably coupled to the frame may be adapted to cause axial movement of the axially movable portion of the roller assembly when the locking lever is pivoted relative to the frame such that pivoting the locking lever to a locked position causes the retainers to move radially away from the elongated portion of the frame and pivoting the locking lever to a released position causes the plurality of retainers to move radially towards the elongated portion of the frame. Motion of the locking lever from the locked position to the released position may cause the axially movable portion to move toward the terminal end and motion of the locking lever from the released position to the locked position may cause the axially movable portion to move toward the contiguous end. The flange may at least partially disengage the roller cover from the roller assembly when the locking lever is moved from the locked position to the released position and the roller cover may exert a force on the flange generally parallel to the elongated portion of the frame and generally in the direction of the contiguous end as the roller cover is installed on the roller assembly, thus causing the locking lever to pivot from the released position to the locked position. The axially movable portion may include a contact portion having a radius that varies along its axial length such that the second ends of the retainers are moved radially outward from the elongated portion of the frame as the axially movable portion is moved toward the contiguous end. The retainers may be composed of metal and may each include a tab adapted to mechanically engage the roller cover when the locking lever is in the locked position. An embodiment of the paint roller may include four retainers.

These and other features and advantages of the present invention will become apparent to those skilled in the art upon consideration of the following detailed description of preferred embodiments exemplifying the best mode of carrying out the invention as presently perceived. The drawings are only to serve for reference and illustrative purposes, and are not intended to limit the scope of the invention.

BRIEF DESCRIPTION OF THE SEVERAL VIEWS OF THE DRAWINGS

The detailed description particularly refers to the accompanying Figures in which.

DETAILED DESCRIPTION OF THE INVENTION

Figure 1:
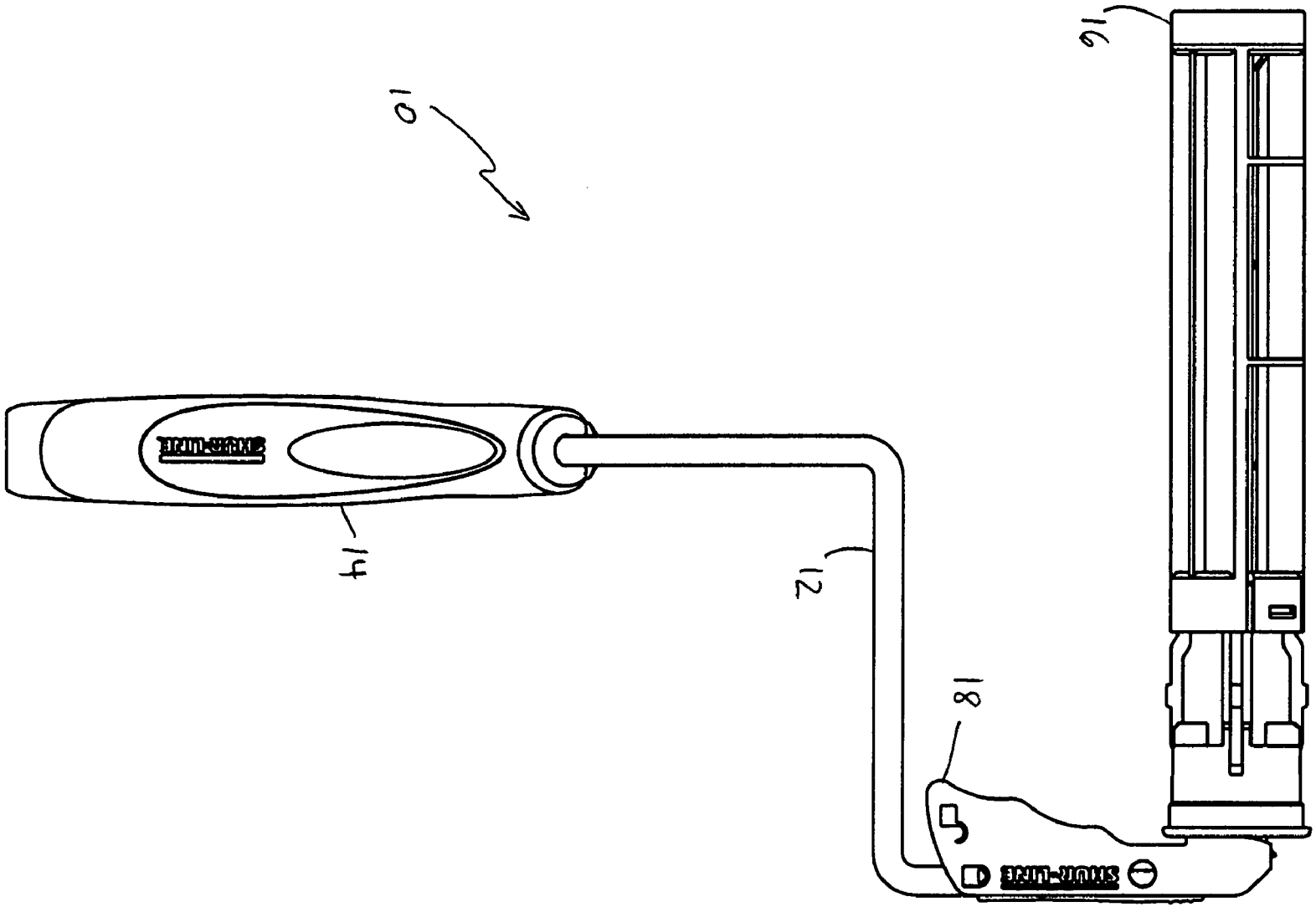
FIG. 1 is a front view of an exemplary embodiment of a paint roller according to the present invention.

As shown in the appended drawings described above, the present invention is comprised of a paint roller 10. Turning to FIG. 1, paint roller 10 preferably includes a frame 12 to which a handle 14 and a roller assembly 16 are attached. The paint roller 10 also includes an locking lever 18 that is pivotally attached to the frame 12.

The frame 12 is preferably made from heavy gauge wire or metal rod. In alternative embodiments, the frame may be made from other suitable materials including plastic or fiberglass. The handle 14 is preferably molded of plastic. Additionally, the handle 14 may be hollow and may include a threaded hole 40 adapted to couple with the end of an extension rod (see FIG. 3). Alternatively, other hand grips known in the art may be used without departing from the scope of the invention.

Figure 2:
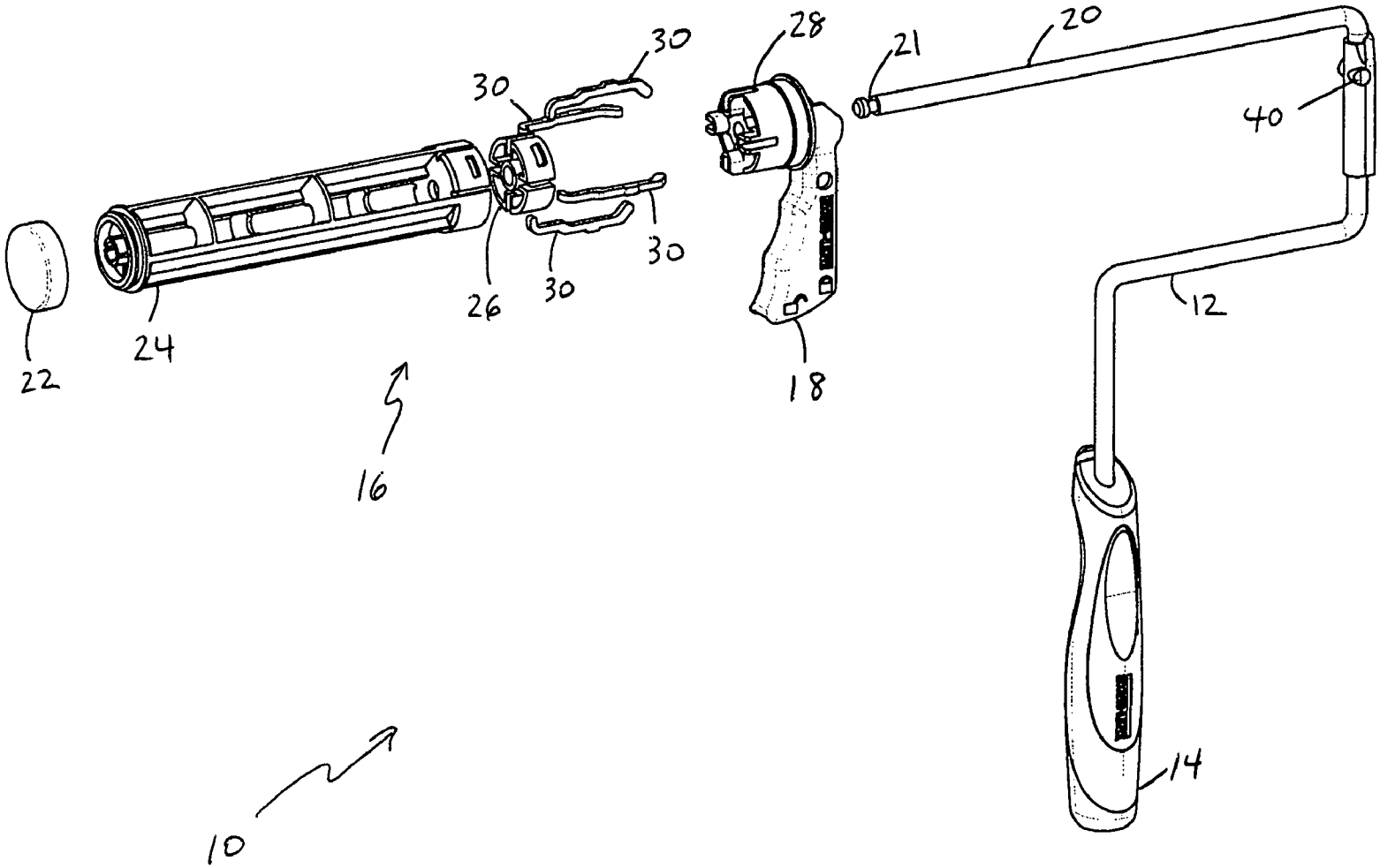
FIG. 2 is a front isometric exploded view of an exemplary embodiment of a paint roller in accordance with the present invention.

As depicted in FIG. 2, the frame 12 preferably includes a roller shaft 20 about which the roller assembly 16 freely rotates. The frame 12 preferably includes a groove 21 near the end of shaft 20. The roller assembly 16 includes tabs 17 that couple with grove 21, thus preventing axial movement of the roller assembly 16 (see FIG. 4). In alternative embodiments, the roller assembly 16 may couple with the frame 12 using other means such as, but not limited to, a retaining ring instead of tabs 17, the end of frame 12 may be swaged to retain the roller assembly 16, or the end of frame 12 may be drilled and tapped to permit the use of a shoulder screw to retain roller assembly 16 on frame 12.

The roller assembly 16 includes an end cap 22, a roller cage 24, a fixed hub 26, a sliding hub 28, and retainers 30. When assembled, the locking lever 18 rotates about pivot point 40. The components of the roller assembly 16 are preferably composed of molded plastic, with the exception of the retainers 30 which are preferably composed of metal.

Figure 3:
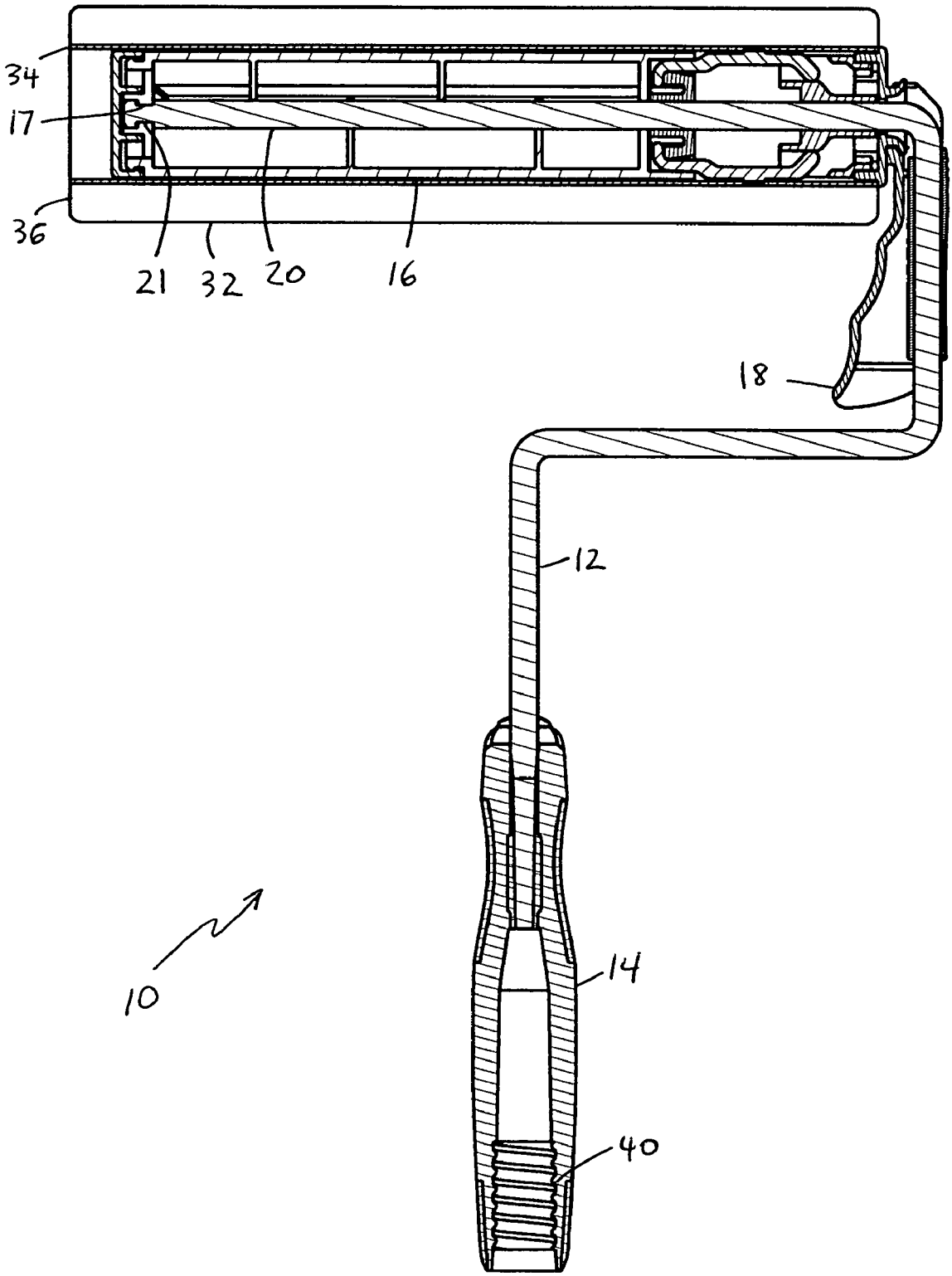
FIG. 3 is a front section view of an exemplary embodiment of a paint roller in accordance with the present invention.

As shown in FIG. 3, the roller assembly 16 is adapted to accept a roller cover 32. The roller cover 32 is preferably a removable paint roller cover as is well known in the art. The roller cover includes a rigid tube 34 around which a nap portion 36 is affixed. The outer diameter of the roller assembly 16 is slightly less than the inner diameter of the rigid tube 34 of the roller cover 32, thus permitting the roller cover 32 to easily slide over the roller assembly 16 except when tabs 38 are engaged as described below.

Figure 4:
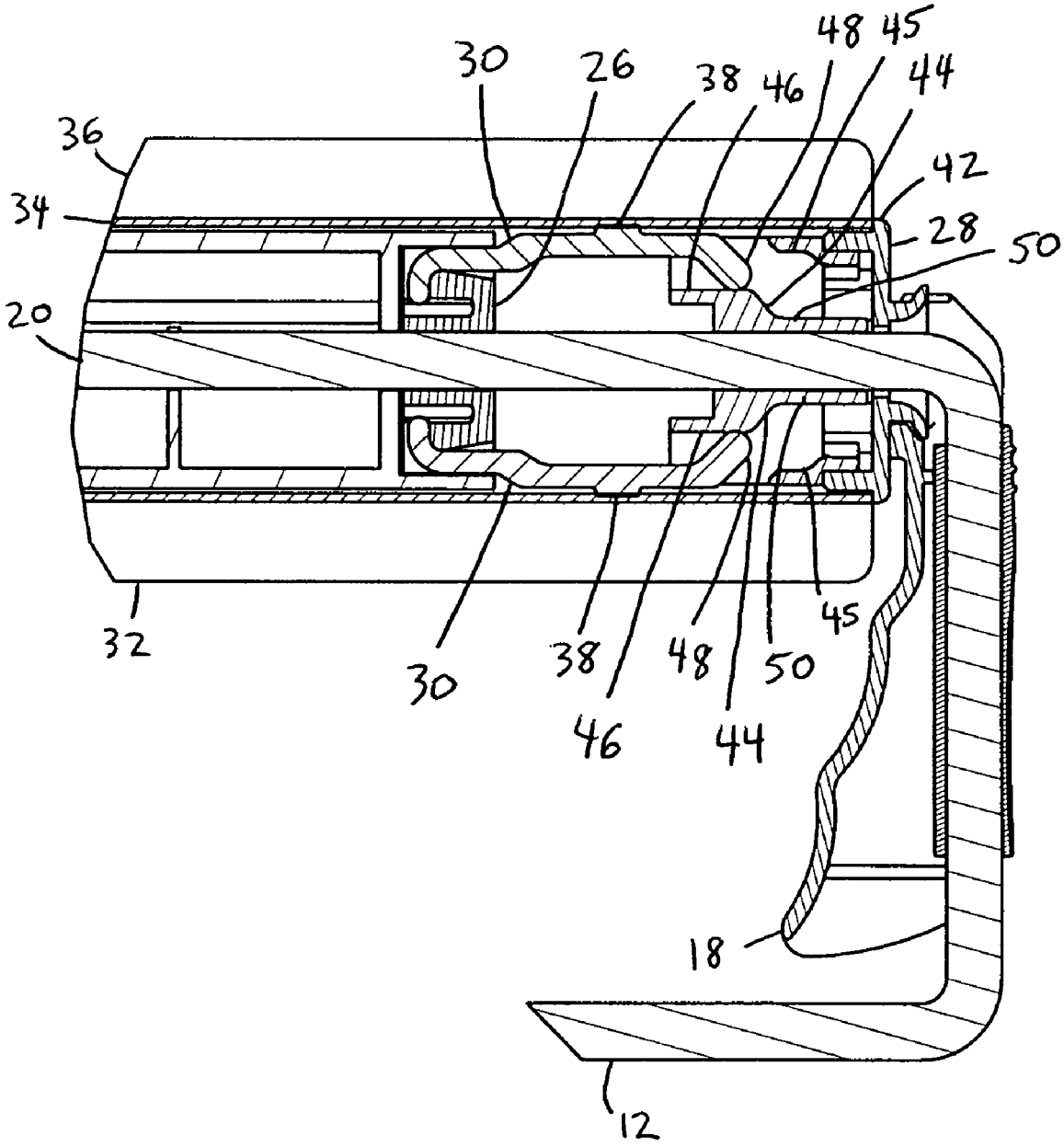
FIG. 4 is a detailed section view of an exemplary embodiment of a paint roller in accordance with the present invention with the locking lever in the locked position.

FIG. 4 shows a detailed section view of a portion of the roller assembly 16 with a roller cover 32 mounted thereon. The locking lever 18 is in the locked position and the retainers 30 are in the extended position, such that tabs 38 are extended radially into contact with the rigid tube 34 of the roller cover 32. In this position, the tabs 38 exert sufficient force on the rigid tube 34 of the roller cover 32 that the roller cover is not readily slidable along the roller assembly 16. The roller assembly 16 remains rotatable relative to the shaft 20. It is within the scope of the invention to utilize retainers 30 having other shapes. In particular, tabs 38 may have alternative shapes or may be comprised of alternative structures. For example, the tabs 38 may have a sloped profile as discussed below with regard to FIG. 10. Further, the retainers 30 may include no tabs 38 or an alternative tab structure such as, but not limited to, a series of small teeth, a rubber coating, or a coating composed of another non-slip material.

Figure 5:
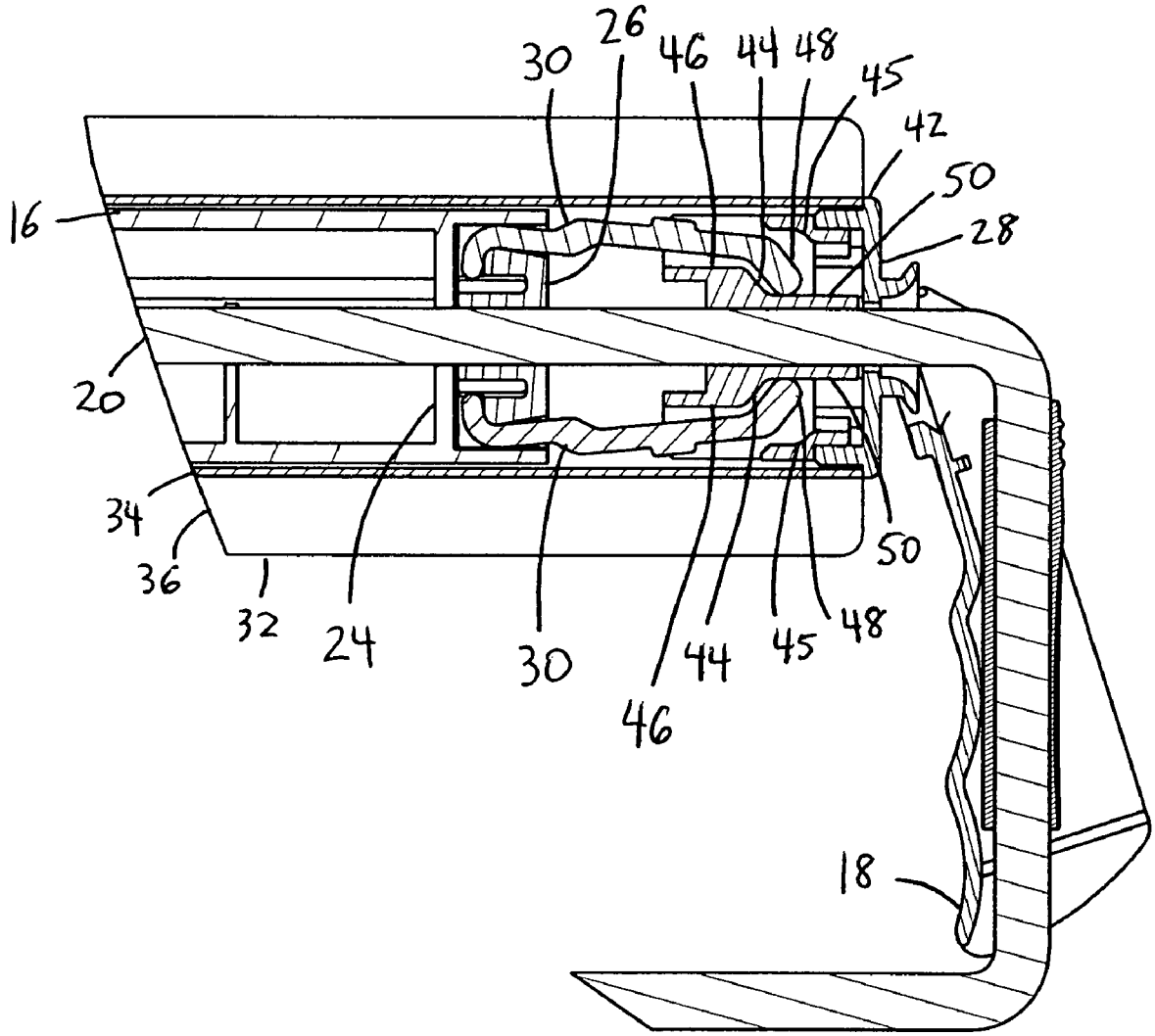
FIG. 5 is a detailed section view of an exemplary embodiment of a paint roller in accordance with the present invention with the locking lever in the released position.

FIG. 5 shows a detailed section view of the same portion of the roller assembly 16 as is depicted in FIG. 4, however, the locking lever 18 is in the released position. The tabs 38 are retracted radially inward towards the shaft 20 and are not in contact with the rigid tube 34 of the roller cover 32. In this position the tabs 38 do not restrict the axial movement of the roller cover 32. The retainers 30 are captured between the fixed hub 26 and the roller cage 24 such that the retainers can pivot radially to engage and disengage the tabs 38 as described above.

The exemplary embodiment of the paint roller 10 is operated as follows. Starting without a roller cover 32 installed, the user places the locking lever 18 in the released position as is depicted in FIG. 5. This causes the sliding hub 28 to slide axially along the shaft towards the end cap 22. As the sliding hub 28 moves towards the end cap 22, end portions 48 of the retainers 30 slide from the outer surfaces 46, radially inward on the engaging inclines 44, and onto the inner surfaces 50. It is possible that the retainer 30 will not freely move radially inward towards shaft 20. In such a case, the end portions 48 will slide along disengaging inclines 45 that positively direct end portions 48 radially inward towards inner surfaces 50. With the end portions 48 of retainers 30 resting on the inner surfaces 50, the tabs 38 are within the diameter of the assembly 16.

The user may then install a new roller cover 32 onto the paint roller 10. The user inserts the roller assembly 16 into the rigid tube 34 of a roller cover 32. Because the tabs 38 of the retainers 30 are retracted, the roller cover 32 slides freely until it contacts flange 42 of the sliding hub 28. Once the roller cover contacts the flange 42, the user continues to insert the roller assembly 16 into the roller cover 32. This causes the roller cover 32 to push on the sliding hub 28 in the axial direction away from the end cap 22. The movement of the sliding hub 28 away from the end cap 22 has two effects. First, the end portions 48 of the retainers 30 slide over the engaging inclines 44 and onto the outer surfaces 46. As a result, retainers 30 pivot radially outward and tabs 38 engage the rigid tube 34 of the roller cover 32. Second, the movement of the sliding hub 28 away from end cap 22 causes the sliding hub 28 to rotate locking lever 18 into the locked position.

With the tabs 38 engaging the roller cover 32 and the locking lever 18 in the locked position, the roller cover 32 is firmly affixed to the roller assembly 16. The user may use the paint roller 10 as desired to apply paint to a surface. Of note, although the device is conventionally referred to as a paint roller, it is well understood in the art that paint rollers may be used to apply a wide variety of coatings in addition to paint.

When the user has finished using the paint roller 10 or wishes to replace the roller cover 32, the user holds the paint roller 10 such that the end cap 22 points towards the floor. The user preferably holds the paint roller over a trash can, bucket, sink, or other receptacle appropriate for receiving a used roller cover 32 that is wet with paint. The user then moves locking lever 18 from the locked position to the released position, thus rotating the locking lever about pivot point 40. This causes the locking lever 18 to push the sliding hub 28 axially along the shaft 20 towards end cap 22. Alternatively, the user may firmly tap the locking lever 18 against the edge of a trash can, bucket, sink, or other receptacle to achieve the same effect without having to directly touch the locking lever 18, which may be covered in paint.

The axial movement of the sliding hub 28 along the shaft 20 towards end cap 22 has two effects. First, end portions 48 of retainers 30 slide along engaging inclines 44 as sliding hub 28 moves towards the end cap 22. This causes the retainers 30 to rotate such that tabs 38 disengage from the rigid tube 34 of the roller cover 32. As discussed above, the end portions 48 may also contact disengaging inclines 45 which may force end portions 48 radially inward towards the shaft 20. Once the tabs 38 are disengaged from the rigid tube 34, the roller cover 32 slides freely along the roller assembly 16.

Second, flange 42 on sliding hub 28 pushes on rigid tube 34 of roller cover 32. This causes the roller cover 32 to slide partially off of roller assembly 16. This partial disengagement should be sufficient to free the roller cover 32 from adhering to the roller assembly due to paint accumulated during use.

Figure 6:
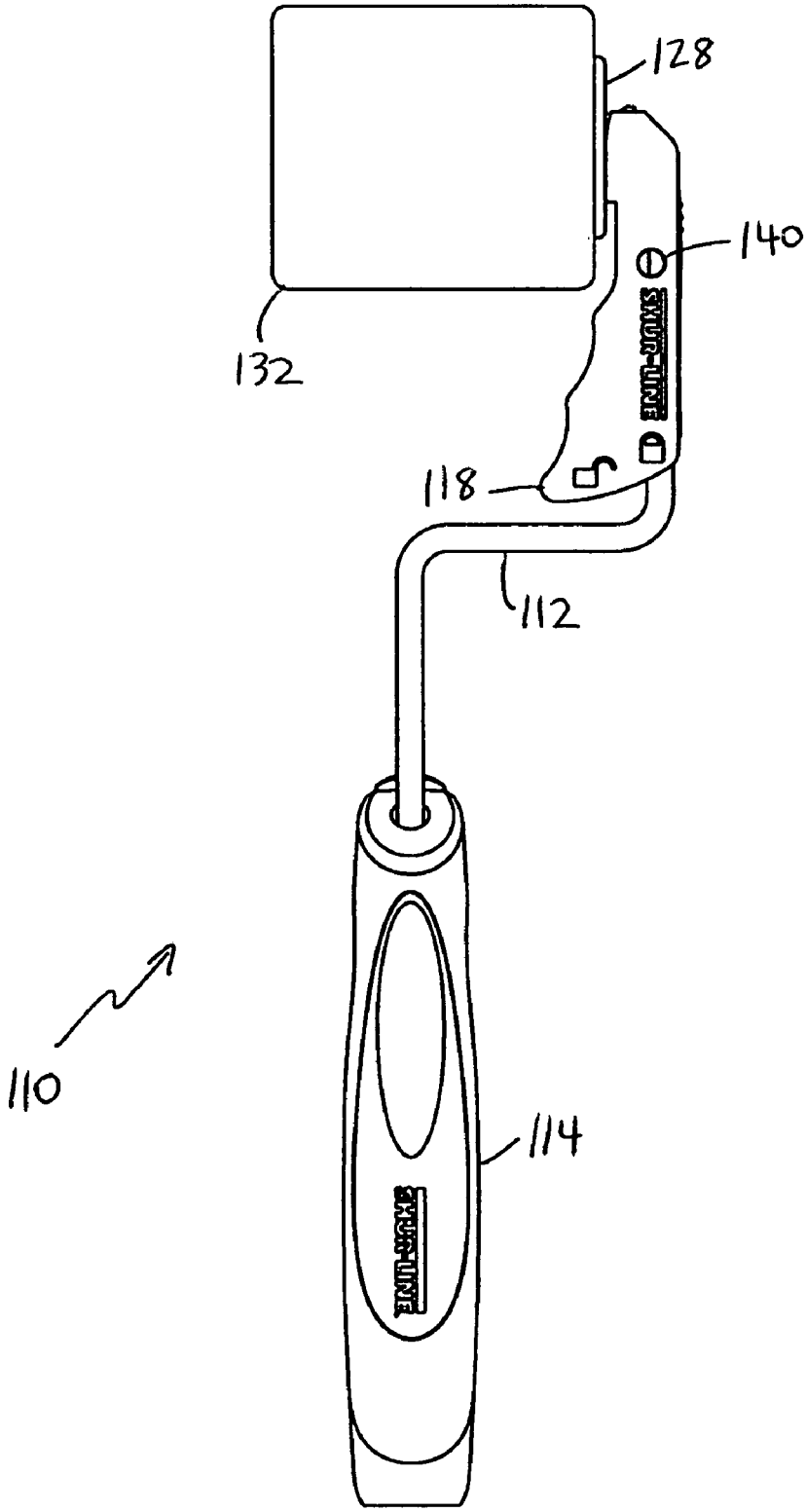
FIG. 6 is a front view of an exemplary embodiment of a paint roller including a short roller cover in accordance with the present invention.
Figure 7:
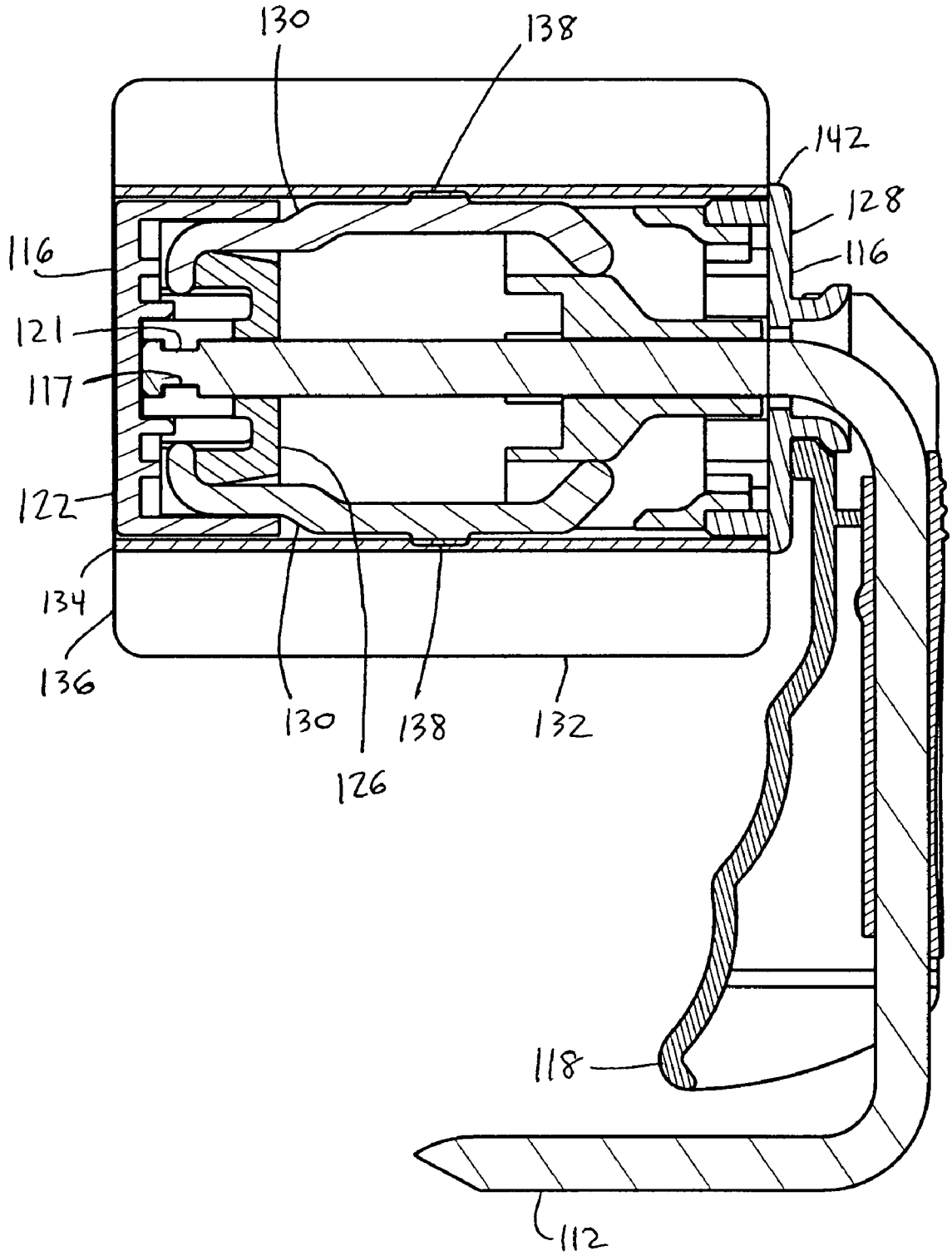
FIG. 7 is a detailed section view of an exemplary embodiment of a paint roller including a short roller cover in accordance with the present invention.
Figure 8:
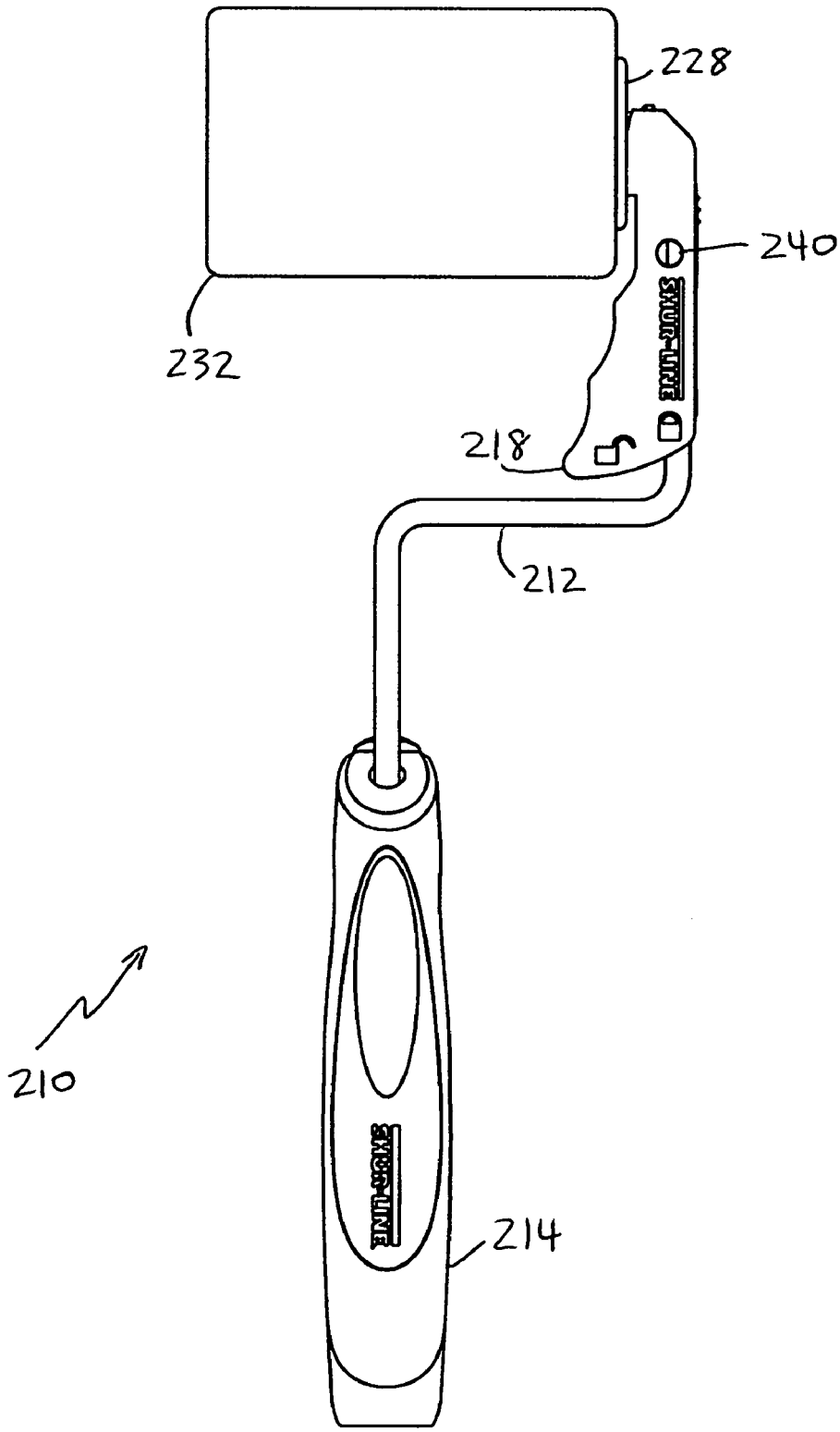
FIG. 8 is a front view of an exemplary embodiment of a paint roller including an alternative short roller cover in accordance with the present invention.
Figure 9:
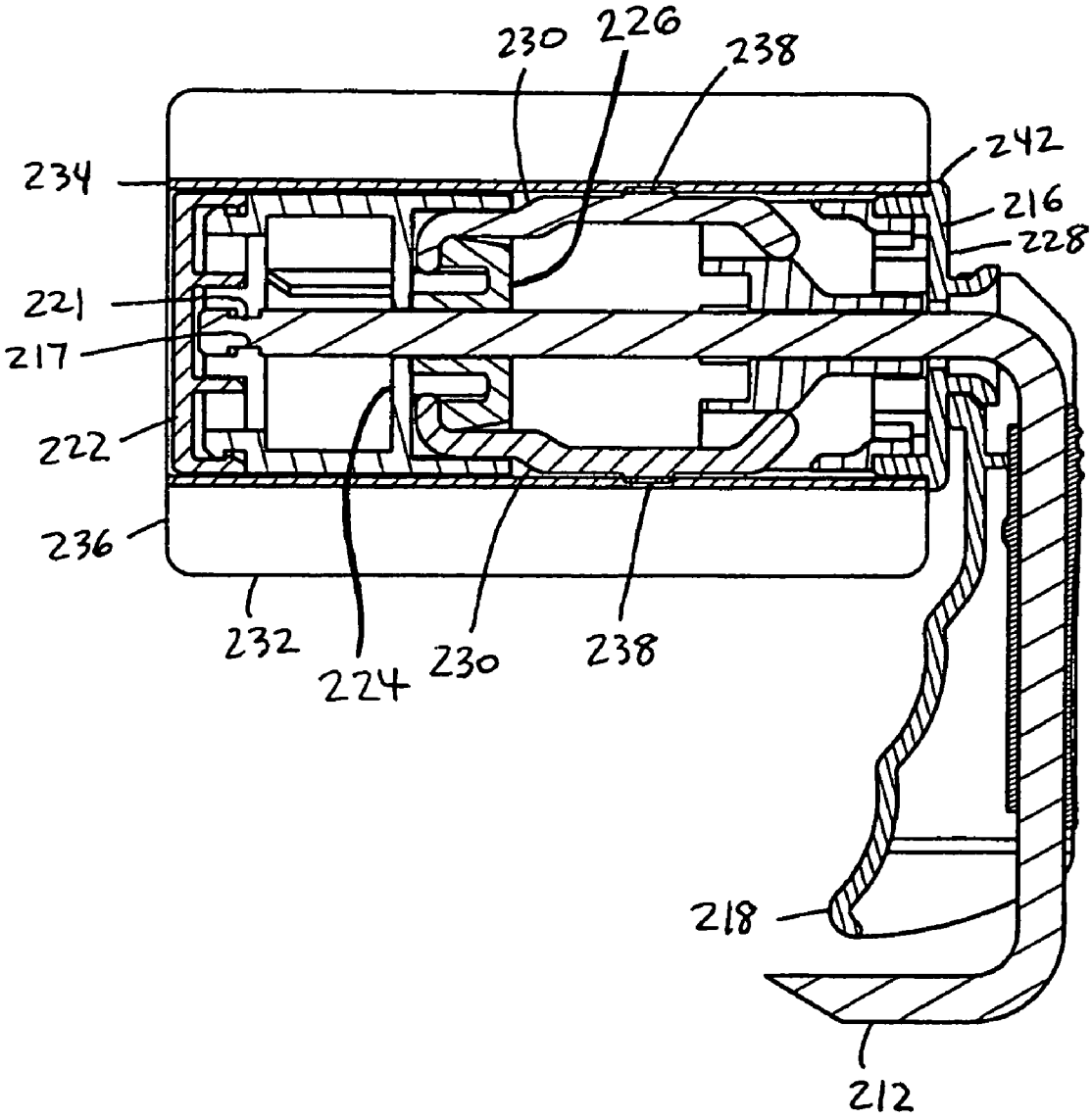
FIG. 9 is a detailed section view of an exemplary embodiment of a paint roller including an alternative short roller cover in accordance with the present invention.

Although FIGS. 1-5 depict a 1.5" (3.81 cm) diameter by 9" (22.86 cm) long roller, it is within the scope of the invention to utilize the locking mechanism of the exemplary embodiment on other sizes of rollers. See, e.g., FIGS. 6 and 7 depicting a 1.5" (3.81 cm)×3" (7.62 cm) roller and FIGS. 8 and 9, depicting a 1.5" (3.81 cm)×4" (10.16 cm) roller. In addition, the roller may be 1.5" (3.81 cm) in diameter and either 7.0" (17.78 cm) or 9.5" (24.13 cm) in length. It is also within the scope of the invention to utilize the locking mechanism of the exemplary embodiment on roller frames adapted to accept roller covers of other diameters and lengths.

In the embodiment shown in FIGS. 6 and 7, the construction and operation of the paint roller 110 is similar to that described above with regard to the standard sized paint roller 10. The paint roller 110 includes a handle 114, a frame 112, a locking lever 118, and a pivot point 140. The roller cover 132 includes a rigid tube 134 and a nap portion 136. The roller assembly 116 includes a sliding hub 128, retainers 130 with tabs 138, and a fixed hub 126. This embodiment differs from the standard sized paint roller embodiment described above in that the end cap 122 is located immediately adjacent to the fixed hub 126, rather than including a roller cage 24 between the fixed hub 126 and end cap 122. This difference is due to the shorter length of the roller cover 132 for which this embodiment is designed.

Likewise, in the embodiment shown in FIGS. 8 and 9, the construction and operation of the paint roller 210 is similar in construction and operation to that described above with regard to the standard sized paint roller 10. The paint roller 210 includes a handle 214, a frame 212, a locking lever 218, and a pivot point 240. The roller cover 232 includes a rigid tube 234 and a nap portion 236. The roller assembly 216 includes a sliding hub 228, retainers 230 with tabs 238, and a fixed hub 226. Unlike the embodiment shown in FIGS. 6 and 7 (and similar to the embodiment shown in FIGS. 1-5 for a standard sized roller cover), this embodiment includes a roller cage 224 located between the fixed hub 226 and the end cap 222.

Figure 10:
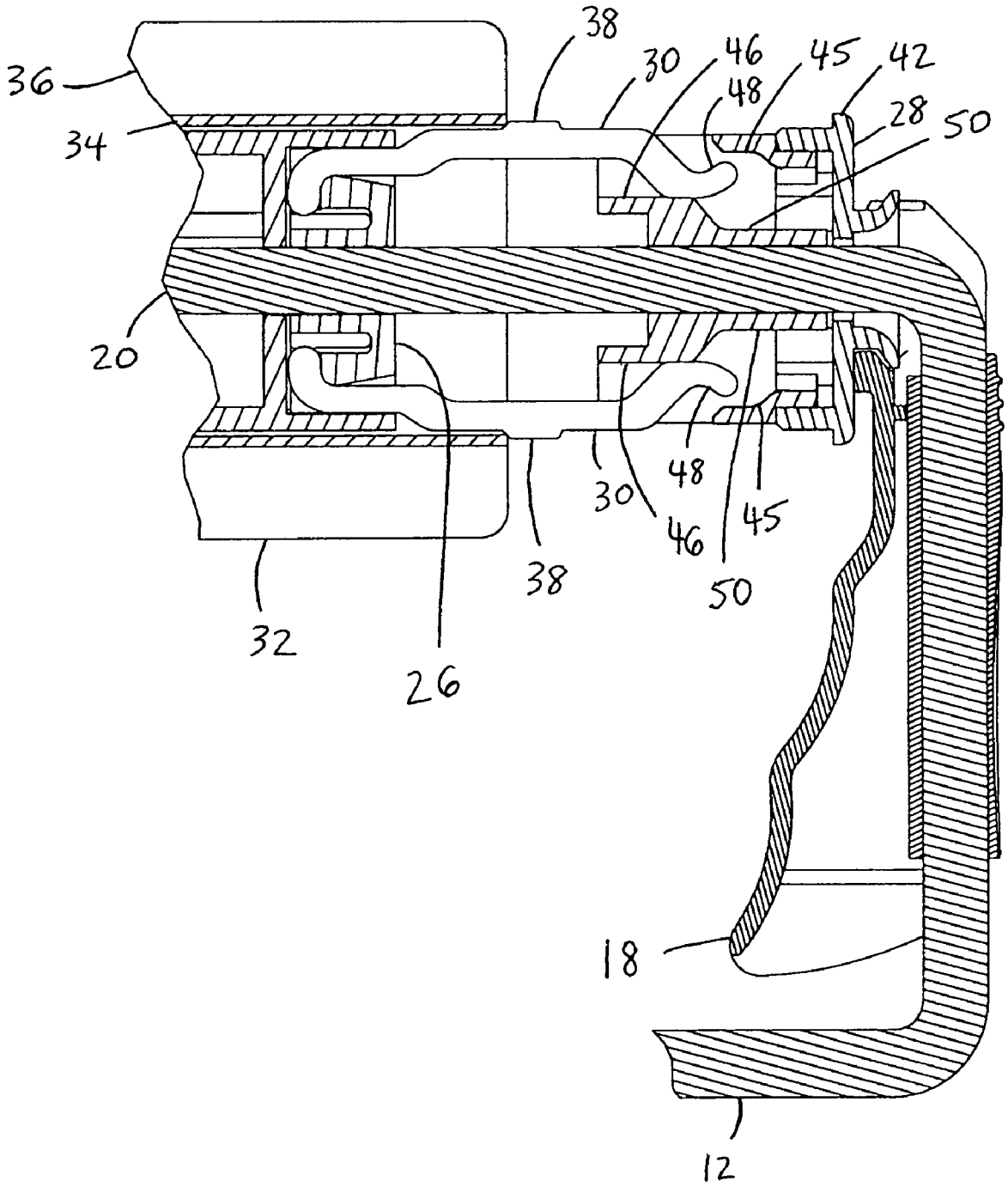
FIG. 10 is a detailed section view of an exemplary embodiment of a paint roller including alternative embodiment retainers.

FIG. 10 depicts an exemplary embodiment of a paint roller assembly including an alternative embodiment of retainer 30 with sloped tabs 38. The sloped tabs 38 permit installation of the roller cover 32 while the locking lever 18 is in the locked position. In this exemplary embodiment, installing the roller cover 32 causes the rigid tube 34 to contact the sloped tabs 38. The retainers 30 deflect slightly radially inward towards shaft 20 and rigid tube 34 deforms slightly as the rigid tube 34 slides over the tabs 38. Removal of the roller cover 32 from the roller assembly 16 is accomplished as described above.

While preferred embodiments of the invention have been set forth above for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A paint roller comprising:

a frame having an elongated portion, the elongated portion having a terminal end and a contiguous end;

a roller assembly rotatably coupled to the elongated portion of the frame and adapted to receive a removable paint roller cover, the roller assembly including an axially movable portion and a plurality of retainers, the plurality of retainers slidingly engaging the axially movable portion such that axial motion of the axially movable portion causes the retainers move radially relative to the elongated portion of the frame; and a locking lever pivotably coupled to the frame and adapted to cause axial movement of the axially movable portion of the roller assembly when the locking lever is pivoted relative to the frame.

2. The paint roller of claim 1, wherein pivoting the locking lever to a locked position causes the plurality of retainers to move radially away from the elongated portion of the frame and pivoting the locking lever to a released position causes the plurality of retainers to move radially towards the elongated portion of the frame.

3. The paint roller of claim 2, wherein motion of the locking lever from the locked position to the released position causes the axially movable portion to move toward the terminal end and motion of the locking lever from the released position to the locked position causes the axially movable portion to move toward the contiguous end.

4. The paint roller of claim 3, further comprising a flange on the axially movable portion, wherein the flange at least partially disengages the roller cover from the roller assembly when the locking lever is moved from the locked position to the released position.

5. The paint roller of claim 4, wherein the roller cover exerts a force on the flange generally parallel to the elongated portion of the frame and generally in the direction of the contiguous end as the roller cover is being installed, thus causing the locking lever to pivot from the released position to the locked position.

6. The paint roller of claim 2, wherein each of the plurality of retainers has a first end pivotably captured by a portion of the roller assembly and a second end including a contact surface that slidably contacts the axially movable portion.

7. The paint roller of claim 6, wherein a radius of a contact portion of the axially movable portion varies along its axial length such that the second ends of the plurality of retainers are moved radially outward from the elongated roller portion of the frame as the axially movable portion is moved axially toward the contiguous end.

8. The paint roller of claim 7, wherein the plurality of retainers are composed of metal.

9. The paint roller of claim 8, wherein each of the plurality of retainers includes a tab adapted to mechanically engage the roller cover when the locking lever is in the locked position.

10. The paint roller of claim 9, wherein the plurality of retainers includes four retainers.

11. The paint roller of claim 9, wherein the tab includes a sloped surface.

12. A paint roller comprising:

a frame having an elongated portion, the elongated portion having a terminal end and a contiguous end;

a roller assembly rotatably coupled to the elongated portion of the frame and adapted to receive a removable paint roller cover, the roller assembly including an axially movable portion and a plurality of metal retainers, the plurality of retainers slidingly engaging the axially movable portion such that axial motion of the axially movable portion causes the plurality of retainers to move radially relative to the elongated portion of the frame and each of the plurality of retainers has a first end pivotably captured by a portion of the roller assembly and a second end including a contact surface that slidably contacts the axially movable portion; and a locking lever pivotably coupled to the frame and adapted to cause axial movement of the axially movable portion of the roller assembly when the locking lever is pivoted relative to the frame, wherein pivoting the locking lever to a locked position causes the plurality of retainers to move radially away from the elongated portion of the frame and pivoting the locking lever to a released position causes the plurality of retainers to move radially towards the elongated portion of the frame;

wherein motion of the locking lever from the locked position to the released position causes the axially movable portion to move toward the terminal end and motion of the locking lever from the released position to the locked position causes the axially movable portion to move toward the contiguous end and wherein a radius of a contact portion of the axially movable portion varies along its axial length such that the second ends of the plurality of retainers are moved radially outward from the elongated roller portion of the frame as the axially movable portion is moved axially toward the contiguous end; and wherein each of the plurality of retainers includes a tab adapted to mechanically engage the roller cover when the locking lever is in the locked position.

13. The paint roller of claim 12, further comprising a flange on the axially movable portion, wherein the flange at least partially disengages the roller cover from the roller assembly when the locking lever is moved from the locked position to the released position.

14. The paint roller of claim 13, wherein the roller cover is adapted to push axially on the flange as the roller cover is being installed, causing the locking lever to pivot from the released position to the locked position.

15. The paint roller of claim 14, wherein the plurality of retainers includes four retainers.

16. A paint roller comprising:

a frame having an elongated portion, the elongated portion having a terminal end and a contiguous end;

a roller assembly rotatably coupled to the elongated portion of the frame and adapted to receive a removable paint roller cover, the roller assembly including an axially movable portion, the axially movable portion having a flange, and a plurality of retainers, the plurality of retainers slidingly engaging the axially movable portion such that axial motion of the axially movable portion causes the plurality of retainers to move radially relative to the elongated portion of the frame and each of the plurality of retainers having a first end pivotably captured by a portion of the roller assembly and a second end including a contact surface that slidably contacts the axially movable portion; and a locking lever pivotably coupled to the frame and adapted to cause axial movement of the axially movable portion of the roller assembly when the locking lever is pivoted relative to the frame such that pivoting the locking lever to a locked position causes the plurality of retainers to move radially away from the elongated portion of the frame and pivoting the locking lever to a released position causes the plurality of retainers to move radially towards the elongated portion of the frame;

wherein motion of the locking lever from the locked position to the released position causes the axially movable portion to move toward the terminal end and motion of the locking lever from the released position to the locked position causes the axially movable portion to move toward the contiguous end; and wherein the flange at least partially disengages the roller cover from the roller assembly when the locking lever is moved from the locked position to the released position and the roller cover exerts a force on the flange generally parallel to the elongated portion of the frame and generally in the direction of the contiguous end as the roller cover is installed on the roller assembly, thus causing the locking lever to pivot from the released position to the locked position.

17. The paint roller of claim 16, wherein the radius of a contact portion of the axially movable portion varies along its axial length such that the second ends of the plurality of retainers are moved radially outward from the elongated portion of the frame as the axially movable portion is moved toward the contiguous end.

18. The paint roller of claim 17, wherein the plurality of retainers are composed of metal.

19. The paint roller of claim 18, wherein each of the plurality of retainers includes a tab adapted to mechanically engage the roller cover when the locking lever is in the locked position.

20. The paint roller of claim 19, wherein the plurality of retainers includes four retainers.

* * * * *